US010046581B2

(12) United States Patent
Palumbo

(10) Patent No.: US 10,046,581 B2
(45) Date of Patent: Aug. 14, 2018

(54) DECORATING PRINTING MACHINE

(71) Applicant: Projecta Engineering S.R.L., Fiorano Modenese (Modena) (IT)

(72) Inventor: Vincenzo Palumbo, Fiorano Modenese (IT)

(73) Assignee: PROJECTA ENGINEERING S.R.L., Fiorano Modenese (Modena) (IT)

( * ) Notice: Subject to any disclaimer, the term of this patent is extended or adjusted under 35 U.S.C. 154(b) by 0 days.

(21) Appl. No.: 15/540,406

(22) PCT Filed: Dec. 30, 2015

(86) PCT No.: PCT/IB2015/060055

§ 371 (c)(1),
(2) Date: Jun. 28, 2017

(87) PCT Pub. No.: WO2016/108199

PCT Pub. Date: Jul. 7, 2016

(65) Prior Publication Data

US 2018/0079241 A1 Mar. 22, 2018

(30) Foreign Application Priority Data

Dec. 30, 2014 (IT) ..... VR2014A0318

(51) Int. Cl.
*B41J 29/02* (2006.01)
*B28B 11/04* (2006.01)

(52) U.S. Cl.
CPC ..... *B41J 29/02* (2013.01); *B28B 11/048* (2013.01)

(58) Field of Classification Search
CPC ..... B41J 29/02; B41J 29/023; B41J 29/026; B41J 29/04; B41J 29/06; B41J 29/08;
(Continued)

(56) References Cited

U.S. PATENT DOCUMENTS 5,650,037 A * 7/1997 Larson ..... B65C 3/16 156/540
2003/0043226 A1 3/2003 Balcan et al.
(Continued)

FOREIGN PATENT DOCUMENTS

DE 102010060406 5/2012

OTHER PUBLICATIONS

International Search Report for PCT/IB2015/060055 dated May 23, 2016 (3 pages).

*Primary Examiner* — Kristal Feggins
(74) *Attorney, Agent, or Firm* — Tutunjian & Bitetto, P.C.

(57) ABSTRACT

A digital decorator machine for the decoration of products (P), including a support frame, at least one conveyor, for transporting the products (P) to be decorated along an advancement direction, at least one decoration element, associated with said support frame and positioned above said conveyor, said at least one decoration element including respective print heads provided with ejector nozzles for a fluid to be dispensed on the surface of the products (P) to be decorated, and a casing within which at least one support is housed that is integral with said heads. The support is movable, with respect to said casing, between an upper inactive position and a lower operating position, in which said heads are correctly spaced with respect to the surface of the products to be decorated (P).

17 Claims, 6 Drawing Sheets

(58) Field of Classification Search
CPC ... B41J 29/10; B41J 29/12; B41J 29/13; B41J 29/14; B41J 29/15; B28B 11/048
See application file for complete search history.

(56) References Cited

U.S. PATENT DOCUMENTS

| | | | | |
|---|---|---|---|---|
| 2007/0146458 | A1* | 6/2007 | Perego | B41J 3/4071 347/102 |
| 2011/0043554 | A1 | 2/2011 | Silverbrook et al. | |
| 2011/0198024 | A1* | 8/2011 | Lorence | B44C 1/1712 156/230 |
| 2012/0070217 | A1 | 3/2012 | Hendricks et al. | |
| 2013/0088556 | A1* | 4/2013 | Hagspiel | B44C 5/043 347/110 |
| 2013/0293633 | A1 | 11/2013 | Li et al. | |
| 2014/0340445 | A1 | 11/2014 | Achatz et al. | |

* cited by examiner

DECORATING PRINTING MACHINE

TECHNICAL FIELD OF THE INVENTION

The present invention regards a digital decorator machine.

More particularly, the present invention regards a digital decorator machine for products of ceramic tile type, ceramic materials in general, and also wood, fabric or other similar materials.

In the following description, reference is explicitly made to ceramic tiles.

Nevertheless, it is underlined that the teachings of the present invention can be indiscriminately used for the digital decoration of wood, or fabric, or any other suitable material.

STATE OF THE PRIOR ART

In the field of production of ceramic tiles and the like, decoration lines are commonly used which apply inks and/or enamels to the surface of the ceramic product.

Such inks and/or enamels are suitable for creating a specific aesthetic and decorative effect, and also a functional result of protection and coverage for the product itself.

Currently, there is the widespread use of digital decorator machines in this field.

These machines apply the ink and/or the enamel on the ceramic product by means of heads which dispense a jet emitted from nozzles with piezoelectric drive or drive of another type; the actuation and regulation of these nozzles are managed digitally.

Digital decorator machines are currently decidedly preferred with respect to the other machine types, since they allow obtaining a very high graphic resolution in the application of the decorative and/or protective product on the surface of interest, even simulating natural materials such as marble, granite, wood or the like.

Digital decorator machines normally comprise a print area for the ceramic products which consists of a plurality of side-by-side print elements.

Each of such print elements is provided with respective heads for dispensing the ink or the enamel on the surface of interest of the products. Each print element then comprises means for feeding, to the aforesaid dispensing heads, a single type of ink or enamel; for example, each element is suitable for dispensing an ink of a certain color on the surface of interest.

The digital decorator machines currently present on the market have several drawbacks.

Indeed, the machines for digital decoration are conceived for decorating the products in the four-color process manner, with four corresponding print elements.

Nevertheless, such decorator machines can also operate by applying inks or other fluids on the products, which have already been previously prepared with the desired final colors.

There can also be a great number of previously-arranged inks or fluids, in relation to the specific decoration work to be carried out: for example, in some applications, it may be necessary to arranged even 16 side-by-side print elements.

In the execution of certain decoration works, among the various print elements provided on the machine, only some are actually functioning simultaneously, and in some cases only one element may be operational, corresponding to the color that one intends to apply.

Hence, the elements that are not functioning in a certain decorative work have the respective heads arranged very close to the surfaces of the products being decorated, i.e. at very few millimeters from the same.

The non-functioning heads are therefore completely exposed to degrading agents, such as high temperatures and suspended fluid particles.

These degrading agents can, for example, quickly lead to the oxidation of the heads. More generally, such degrading agents are capable of causing malfunctions in the heads, which require operator interventions, replacement of parts, and/or other costly activities.

SUMMARY OF THE INVENTION

The technical task of the present invention is to implement a digital decorator machine that allows overcoming the above-described drawbacks.

In the scope of such technical task, one object of the present invention is to obtain a digital decorator machine adapted to preserve the heads that are temporarily nonfunctioning from degrading agents present in the print area. Such task and such objects are attained by the digital decorator machine according to the present specification.

The digital decorator machine according to the invention comprises a support frame, at least one conveyor, for transporting the products to be decorated along an advancement direction, and at least one decoration element, associated with the support frame and positioned above the conveyor.

The decoration element comprises respective print heads provided with ejector nozzles for a fluid to be dispensed on the surface of the products to be decorated, and a casing within which at least one support bearing the heads is housed.

According to one aspect of the invention, the support of the print heads is movable, with respect to the casing, between an upper inactive position and a lower operating position, and in the latter the heads are correctly spaced with respect to the surface of the products to be decorated in order to dispense the decorative fluid thereon.

Therefore, when the heads are situated in the aforesaid inactive position, the heads are suitably spaced from the surface of the products to be decorated, in a manner so as to not be directly attacked by degrading agents.

According to one embodiment of the invention a removable protection is provided which can be associated with the base of the support of each decoration element, in a manner so as to suitably and further protect the heads from the aforesaid degrading agents.

The present specification refers to preferred and advantageous embodiments of the invention.

BRIEF DESCRIPTION OF THE DRAWINGS

The characteristics of the invention will be better understood by each man skilled in the art from the following description and from the enclosed drawing tables, given as a non-limiting example, in which.

DETAILED DESCRIPTION

Figure 1:
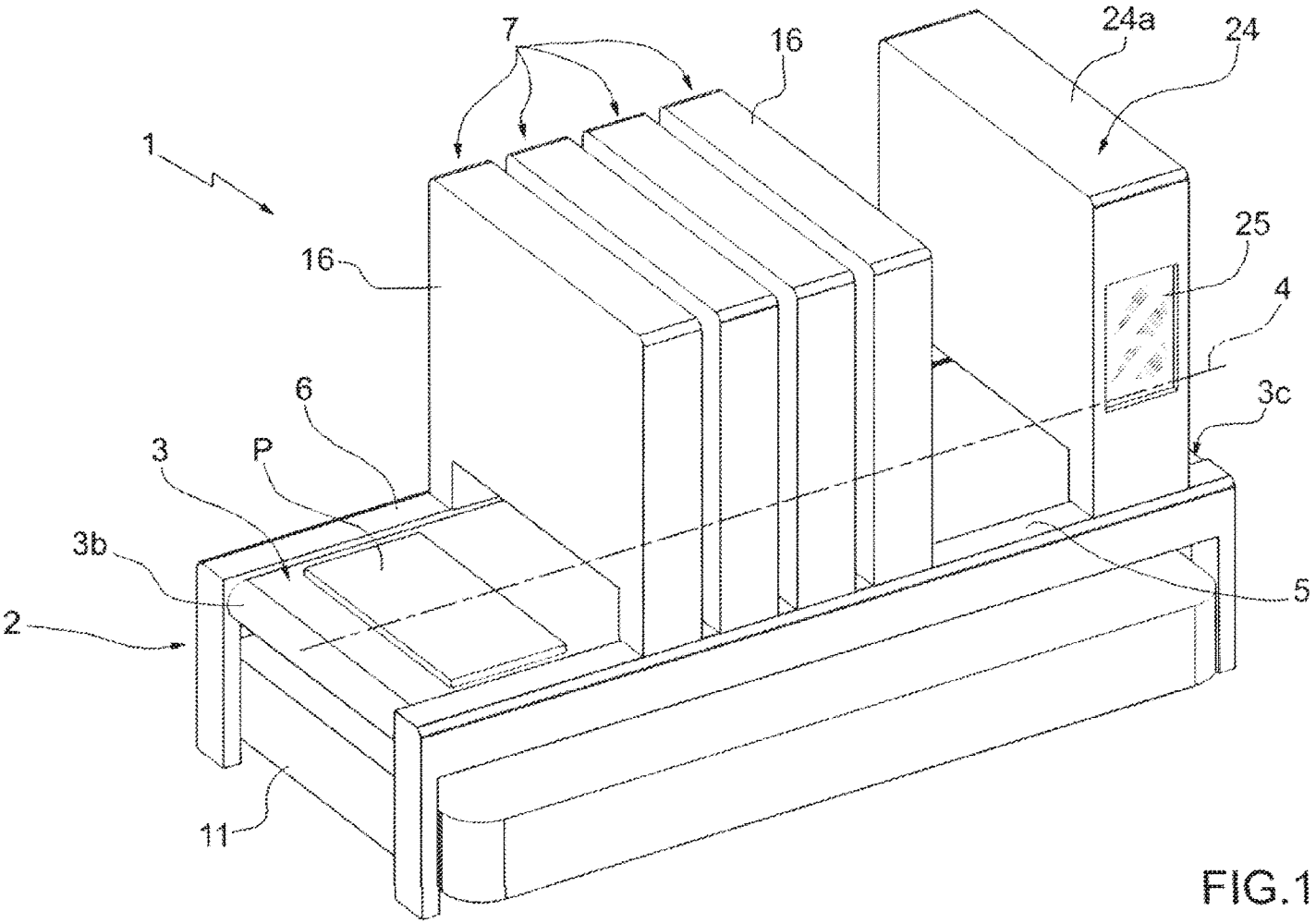
FIG. 1 is a front perspective view of a digital decorator machine according to the invention.

With reference to the enclosed FIG. 1, reference number 1 overall indicates a digital decorator machine according to the present invention.

The machine 1 according to the invention is particularly, but exclusively, indicated for applying decorative and/or protective fluids, such as inks, enamels and the like on products such as ceramic tiles and the like.

Nevertheless, the machine 1 according to the invention could be indiscriminately used also for other types of ceramic products, and possibly also for non-ceramic products. It is also specified that the decorator machine 1 according to the present invention allows applying fluids such as inks, enamels and the like on ceramic products in any state, i.e. raw, baked, or any other state.

In the following description, the products to be decorated P are constituted by ceramic tiles, of any shape and size.

That said, however, the machine 1 according to the present invention is likewise suitable for the digital decoration of parts made of other materials such as wood, fabrics 5 and the like.

The machine 1 according to the present invention can be installed in a complete line for the decoration of ceramic tiles.

Such line can for example comprise multiple decorator machines of the same type, i.e. of the type according to the present invention.

The line can also comprise decorator machines of another type, without particular limitations.

The machine 1 comprises a support frame 2. The support frame 2 comprises a conveyor 3 for the products to be decorated P.

The conveyor 3 is suitable for transporting the products to be decorated P along a specific advancement direction 4.

In particular, the conveyor 3 comprises a conveyor belt 3*a*.

The conveyor belt 3*a* is movable along the advancement direction 4 of the products to be decorated P; the conveyor belt 3*a* is supported by two rollers 3*b*, 3*c*, e.g. one motorized and one idle, supported with axes parallel and perpendicular to the advancement direction 4.

The support frame 2 of the machine 1 defines two abutment portions 5,6, parallel to the advancement direction 4 and arranged at the sides of the conveyor belt 3*a*.

More particularly, the abutment portions 5,6 comprise respective longitudinal members of the support frame 2, parallel to the advancement direction 4.

According to one aspect of the present invention, the machine 1 comprises at least one digital decoration element 7 of the products P.

With the term decoration, in particular referred to the at least one digital decoration element 7, it is generally intended the application of decorative fluids in the strict sense of the term, such as colored inks and the like, as well as the application of other products such as protective enamels, and still others.

In some preferred embodiments of the invention, the machine 1 comprises a plurality of digital decoration elements 7.

The digital decoration elements 7 are arranged side-by-side each other along the advancement direction 4 of the products to be decorated P.

It is specified that there can be any number of decoration elements 7 provided in the machine 1, in relation to the specific application needs.

The decoration elements 7 of the machine 1 each comprise respective print heads 8.

The print heads 8 are provided with respective ejector nozzles—not illustrated—for a fluid, e.g. an ink, an enamel, to be superficially dispensed on the products to be decorated P.

The print heads 8 of the machine 1 according to the invention can be of any type, without limitations.

Each of the decoration elements 7 comprises members 9 for feeding the decorative fluid to the print heads 8. The feed members 9 of each of the decoration elements 7 communicate with a respective container 10 of the decorative fluid.

The aforesaid container 10, which feeds a respective decoration element 7 of the machine 1, can be positioned in the most suitable zone of the machine 1 itself.

For example, according to one version of the invention, particularly interesting with regard to the overall bulk of the machine 1, the container 10 can be positioned in a suitable box 11 associated with the support frame 2.

Figure 2:
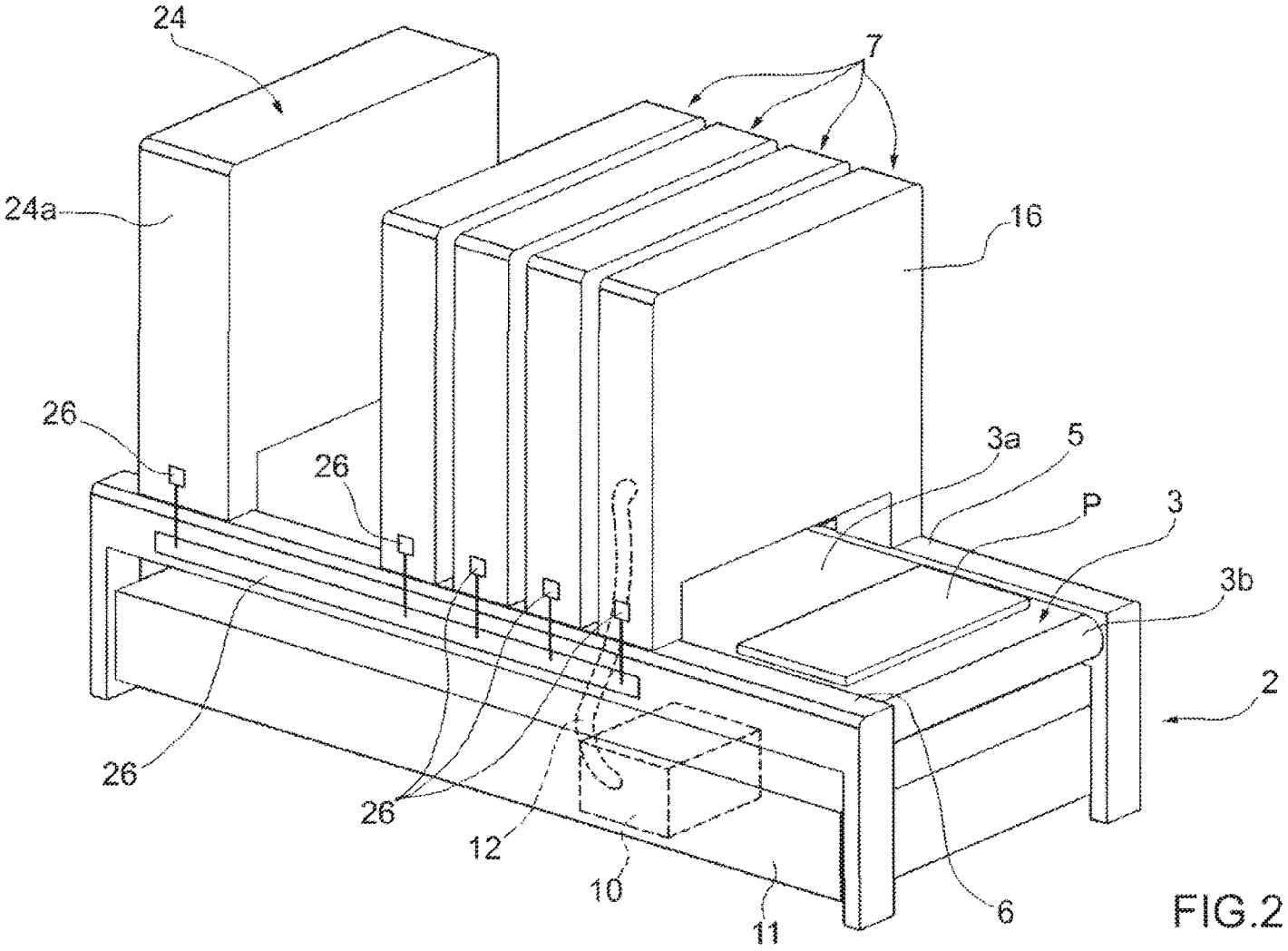
FIG. 2 is a rear perspective view of the machine.

The transfer of the decorative fluid from the container 10 to the feed members 9 is carried out by means of suitable piping 12 (see for example FIG. 2).

The piping 12 can be associated with quick connectors which allow exchanging, in a practical and quick manner, the fluid connections between the decoration elements 7 and the respective containers 10.

The feed members 9 can be suitable for creating, within the respective decoration element 7, an autonomous circulation of decorative fluid during the operation of the machine 1, so as to preserve the decorative fluid itself in the best operating conditions, even when the print heads 8 are not operative.

For this reason, the feed members 9 can comprise, for example, one or more tanks 13 inserted in series in the circuit in which the decorative fluid circulates, associated with a pump 14 or with other equivalent means.

In addition, the feed members 9 comprise at least one electronic control board 15 which manages the operation of the print heads 8.

In particular, the control board 15 constantly manages and verifies the decorative fluid dispensing operations of the print heads 8 themselves.

Each decoration element 7 is provided with a respective casing 16, which contains, encloses and supports all the functional components of the element 7 itself.

Each decoration element 7 comprises at least one support 17, which is associated with at least the print heads 8.

Figure 7:
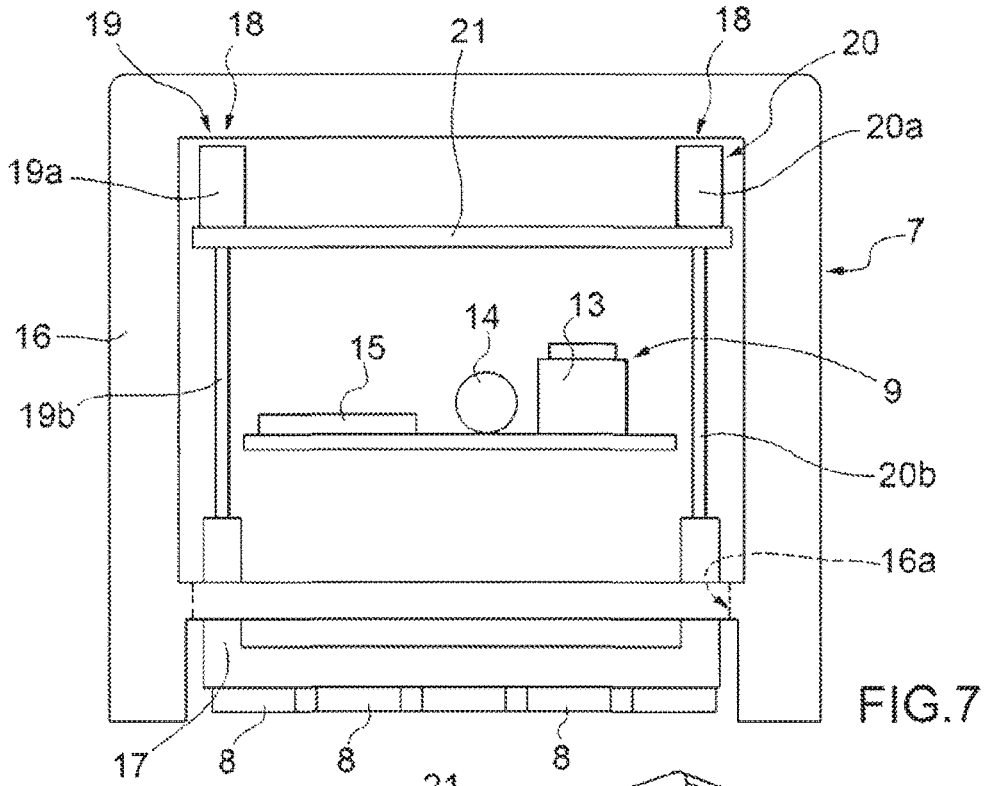
FIG. 7 is another side view of a print element of the machine, with the support of the 5 print heads in the operating position.
Figure 8:
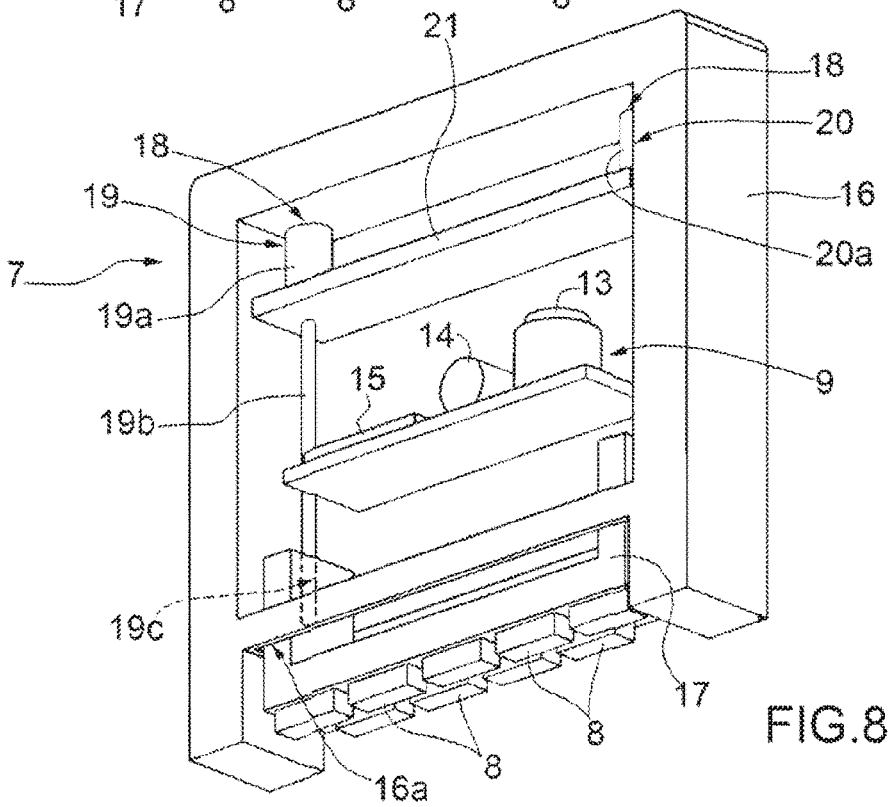
FIG. 8 is a perspective view of a print element of the machine, with the support of the print heads in the operating position.

The support 17 is partially or completely contained within the respective casing 16. According to one aspect of the present invention, the support 17 bearing the print heads 8 is movable, with respect to the casing 16, between a first inactive position, illustrated in FIGS. 5 and 6 (FIG. 2) and an operating position, illustrated in FIGS. 7 and 8. In particular, the support 17 is associated with respective movement members 18. The movement members 18 are partially or completely contained inside the casing 16. In particular, the movement members 18 allow selectively translating the support 17 from the aforesaid inactive position to the aforesaid operating position, and vice versa, according to a direction that is preferably but not exclusively vertical, or substantially vertical.

A lower opening 16*a* is suitably provided in the casing 16, through which the print heads 8 can reach the aforesaid operating position.

In the functional condition in which the print heads 8 of the decoration element 7 dispense the decorative fluid on the product to be decorated P, the respective support 17 is thus situated in the lower operating position: in this manner, the print heads 8 themselves are correctly positioned with respect to the surface of the products to be decorated P, i.e. they are correctly spaced with respect to the aforesaid surface.

If instead the same decoration element 7 is not in operation, the respective support 17 can be brought into the upper inactive position: in such position, the print heads 8 are suitably situated spaced from the surface of the products to be decorated P, so as to not be affected by the degrading agents which are situated in proximity to the same surface of the products P.

In other words, the print heads 8 of the decoration element 7 in question, which are temporarily not used, are suitably protected from the thermal radiations generated, for example, by the products to be decorated P; in addition, the print heads 8 are also protected from possible particles of decorative fluid which are suspended in the print area during machine 1 operation.

The print heads 8, thus protected, last longer: this signifies that the necessary maintenance operations are reduced, and thus the operation stop times of the machine are shorter, with consequent clear cost advantages.

The support 17 of the print heads 8 can have any shape and size, suitable for obtaining the above-described result in a facilitated manner; the support 17 comprises a base to which the print heads 8 are fixed.

If deemed technically advantageous, the support 17 can also be fixed to several components of the members 9 for feeding the decorative fluid, or even all the components, according to a particular version of the invention that is better described hereinbelow. The movement members 18 of the support 17 bearing the print heads 8 can be indiscriminately with manual actuation or motorized.

More in detail, and according to a particular embodiment of the invention, the movement members 18 comprise first actuator means 19 and second actuator means 20. The first actuator means 19 and the second actuator means 20 are for example associated with a support portion 21 of the casing 16, or by other technically equivalent means.

The support portion 21 can for example be constituted by a bracket element integral with one of the internal walls of the casing 16.

More in detail, the first and second actuator means 19,20 are of linear type, and define respective vertically-arranged movement or translation axes.

According to one version of the invention, the first actuator means 19 and the second actuator means 20 are respectively associated with the opposite ends of the support 17. The first actuator means 19 and the second actuator means 20 respectively comprise a first electric motor 19*a* and a second electric motor 20*a*.

In one embodiment of the invention of particular practical interest, such electric motors 19*a*,20*a* are of stepper type.

The first electric motor 19*a* and the second electric motor 20*a* actuate the respective first and second screws 19*b*,20*b* having respective vertical axes.

The first screw 19*b* and the second screw 20*b* are respectively associated with a first nut screw 19*c* and a second nut screw 20*c* provided in the support 17.

The first electric motor 19*a* and the second electric motor 20*a* can be associated with respective sensors, e.g. linear encoders or the like, for controlling at each instant the actual position of the support 17 with respect to the casing 16.

According to the invention, each decoration element 7 comprises a respective protection 22 for the print heads 8.

Figure 6:
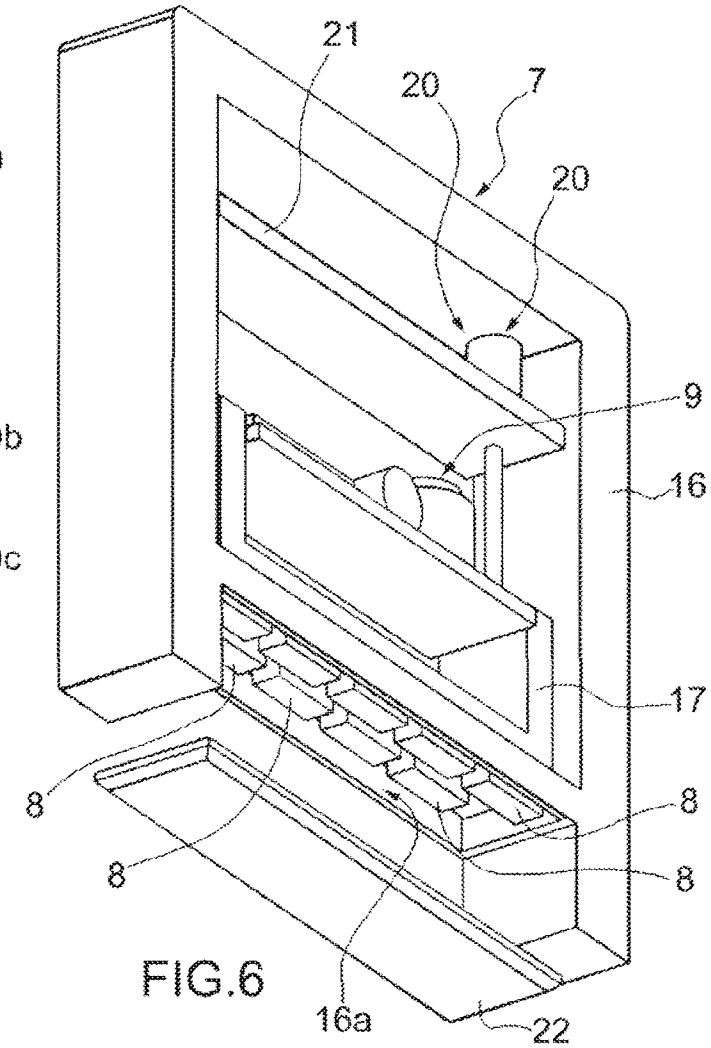
FIG. 6 is a partially exploded perspective view of a print element of the machine, with the support of the print heads in the inactive position.
Figure 5:
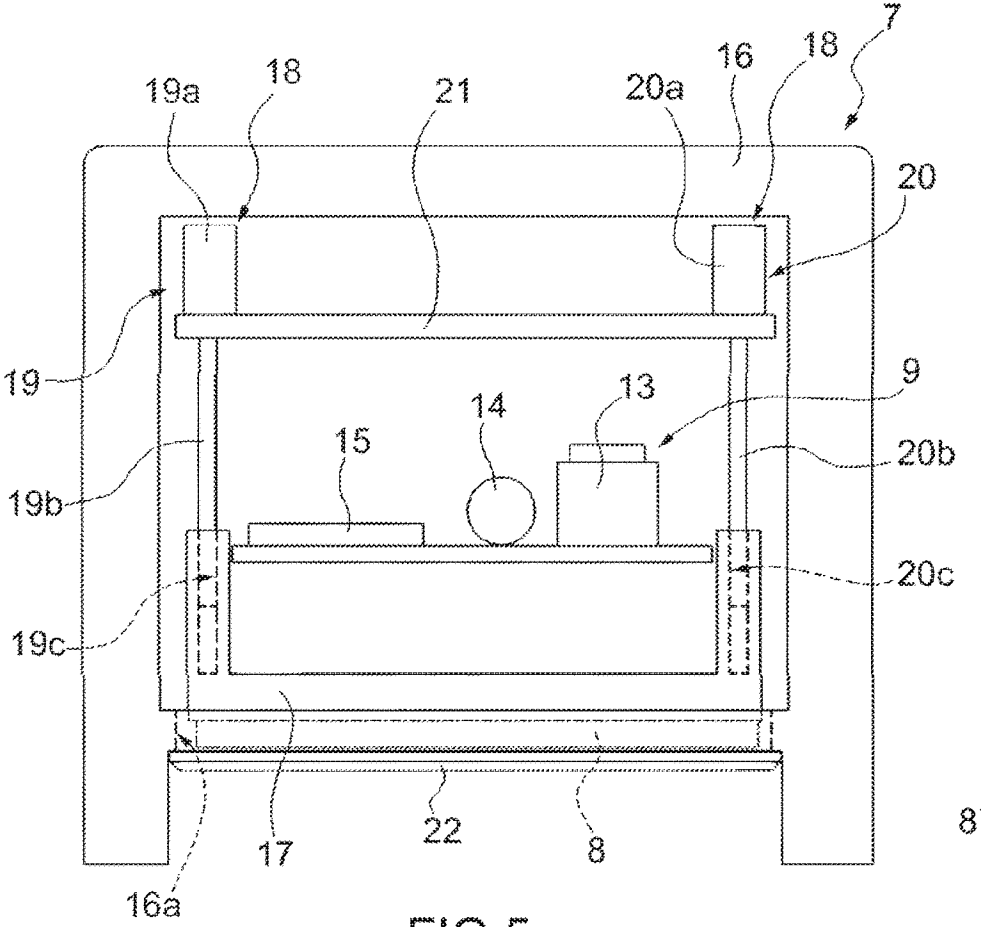
FIG. 5 is a side view of a print element of the machine, with the support of the print heads in the inactive position.

The protection 22 is in particular visible in FIGS. 5,6.

The protection 22 has the important function of protecting (with its lower face) the surfaces of the print heads 8 from the degrading agents, already mentioned above, which could compromise the optimal operation thereof.

The protection 22 preferably but not exclusively has the shape of a tray, or of a tub with concavity that is directed upward during use. The protection 22 can be removably associated with the lower zone of the support 17 bearing the print heads 8, in a manner so as to completely cover the latter.

It is also underlined that the protection 22 is suitable for collecting, due to its concavity, small quantities of decorative fluid, such as ink, enamel, and the like.

This characteristic advantageously also allows maintaining in operation the print heads 8 that are temporarily not used in a specific decoration work, preventing the respective fluid dispensing nozzles from being blocked up, thus collecting the fluid that is dispensed and not necessary in that specific decorative work.

More in detail, it is provided that a specific decoration element 7 that is temporarily not employed is in any case maintained in operation by dispensing (for example occasionally) a certain quantity of fluid, which is collected from the upper face of the protection 22.

Each decoration element 7 of the machine 1 is connectable to the abutment portions 5,6 of the support frame 2 in a removable manner; in this manner, each decoration element 7 can be rendered operatively independent from the rest of the machine 1.

This signifies that, if necessary, a specific decoration element 7 can be removed from the support frame 2, so it can be installed, for example and another machine with equivalent characteristics or for carrying out maintenance operations, modifications or the like thereon.

It is thus possible to equip the machine 1 with a certain number of decoration elements 7 suitable for dispensing inks or enamels, for example with the desired, already-arranged colors.

In other words, the machine 1 is completely personalizable in relation to the specific operating needs.

Finally, the decoration elements 7 can be exchanged between different machines, present in a same decoration line or even in different decoration lines, in order to thus obtain different decoration combinations of the products P.

Figure 3:
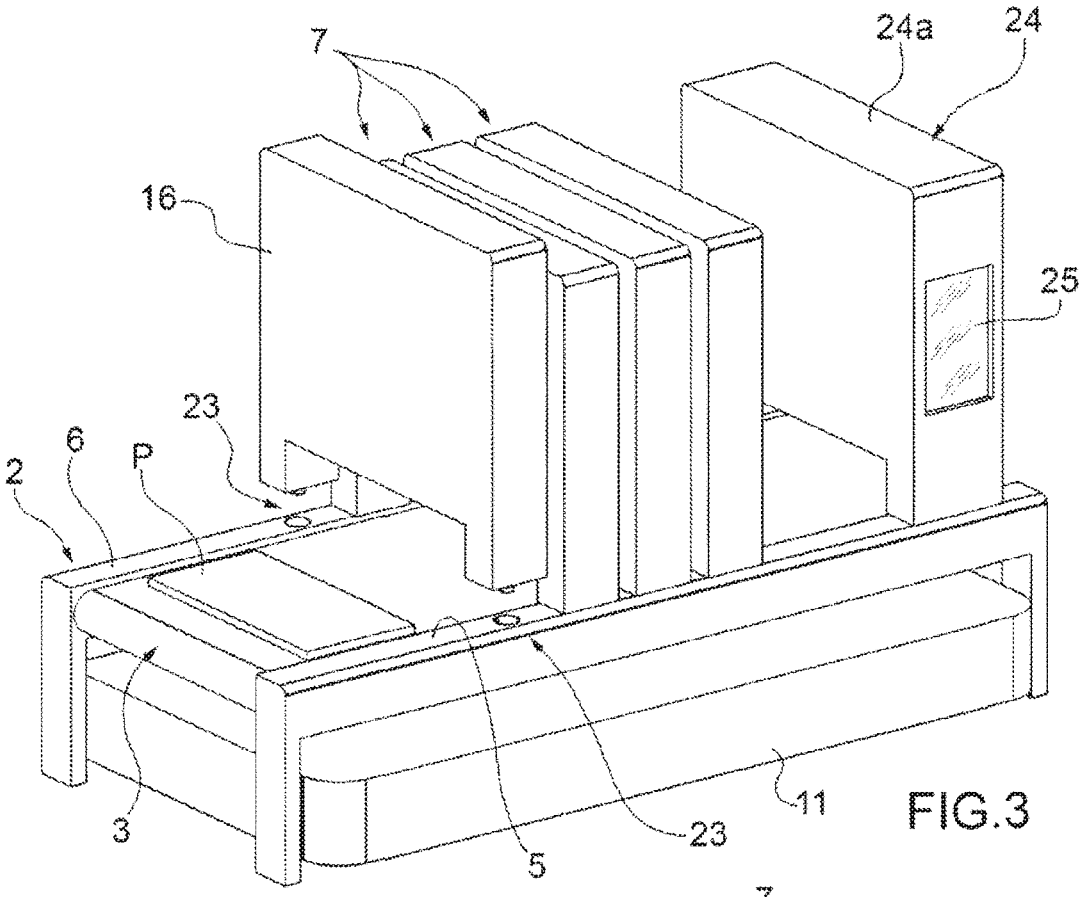
FIG. 3 is another front perspective view of the machine, with a print element removed.
Figure 4:
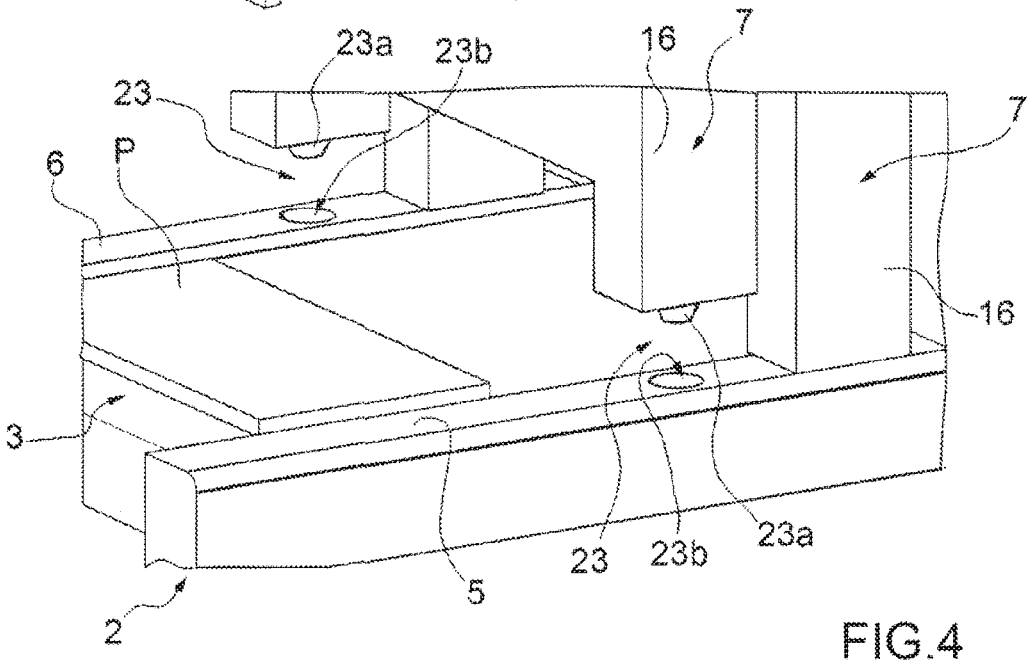
FIG. 4 is a detail of FIG. 3.

With particular reference to FIGS. 3,4, connection means 23 are suitably provided between the casing 16 of each decoration element 7 and the abutment portions 5,6 of the support frame 2: such connection means 23 allow the quick coupling/uncoupling of each decoration element 7 to/from the support frame 2, in order to obtain the above-described effects and advantages. In one embodiment of the invention, the connection means 23 comprise conical portions 23*a* which are extended from opposite ends of the base of the casing 16 of the decoration element 7, and corresponding conical housings 23*b* provided in the abutment portions 5,6 of the support frame 2.

The conicity of the coupling of the connection means 23 allows a quick and precise mounting/dismounting of each decoration element 7 on/from the support frame 2.

Indeed, according to one aspect of the invention, it may often be necessary, during the normal operating conditions of these machines, to replace a specific decoration element 7 with another, or move a specific decoration element 7 from one machine to another, for example in order to vary the sequence of decoration fluids used for carrying out a specific work (often, in order to vary the sequence of the colors of the aforesaid decoration fluids).

These needs can be optimally met since each decoration element 7 is quickly and easily removable from the support frame 2, without difficult dismounting operations of parts. Indeed the connection means 23 are provided in zones of the support frame that are clearly visible and accessible (the abutment portions 5,6).

Each decoration element 7, therefore, in order to be removed, can be simply lifted upward.

The connection means 23 can comprise other temporary locking elements, not illustrated, for locking each decoration element 7 on the support frame 2 of the machine 1.

The machine 1 according to the invention comprises at least one supervision unit 24, suitably for managing the operation of one or more decoration elements 7 during a specific work.

The supervision unit 24 is associated with the support frame 2 of the machine 1.

For example, the supervision unit 24 can be associated with the support frame 2 by means of connection means 23 of the type described above, or other equivalent means. The supervision unit 24 comprises, more in detail, a box-like body 24*a* within which a programmable logic controller (PLC) or another technically equivalent control element is provided, as well as means for the electrical power supply of the machine.

The box-like body 24*a* can be provided with a user interface 25, for the control and setting of the machine operation parameters by the operator, the selection of operating programs, etc.

With reference for example to FIG. 2, the machine 1 comprises electrical connection means 26 suitable for connecting the supervision unit 24 to the decoration elements 7. The electrical connection means 26 allow both the electrical power supply of the single decoration elements 7, and the transfer of data and signals between the various components of the machine 1.

The electrical connection means 26 are of quick connection type, in order to quickly install/remove the decoration elements 7 and/or the supervision unit 24.

The electrical connection means 26 could also partially be of wireless connection type, in order to further facilitate the installation/removal operations.

In some embodiments of the invention, the supervision unit 24 and/or one or more decoration elements 7 can be made integral with the support frame 2.

The operation of the machine 1 according to the invention is the following.

First, the decoration elements 7 are mounted on the support frame 2 of the machine, such decoration elements 7 required for a specific decorative work on the products P, or even possibly other decoration elements 7 not strictly necessary for that work but, for example, to be used afterward.

After this, the supports 17 of the decoration elements 7 involved in that specific work are moved, by the movement members 18, into the respective operative positions, in a manner such that the respective print heads 8 are situated correctly spaced with respect to the surface of the products to be decorated P.

The supervision unit 24 will therefore start the decorative operations, managing and controlling the operation of the decoration elements 7 which must dispense the respective decorative fluids.

If, during the execution of the same decoration work, or in preparation for a subsequent work, it is necessary to exclude one or more decoration elements 7 installed on the machine 1, the respective supports 17 can be lifted, quickly and easily, by the movement members 18, and be brought into the respective inactive positions; after this, the respective protections 22 can also be mounted in a manner so as to protect the print heads 8.

The decoration elements 7 that are temporarily not used, or which require modifications, maintenance etc., can be easily removed, and possibly also installed on other machines 1.

The solution according to the invention allows obtaining important technical advantages.

As stated, first of all, the print heads 8 not employed in a specific operation are suitably lifted by the movement members 18 into their inactive position, in a manner such that they can be covered with the protection 22: the conditions of the heads 8 are thus preserved for a considerably greater time period with respect to what occurs in the machines of known type.

Another considerable advantage consists of the fact that the machine 1 according to the invention, due to its particular shape and structure, is more compact and less bulky than the machines of known type, which is particularly important in the preparation of a complete decoration line.

In addition, it is observed that, given the possibility to remove the single decoration elements 7 from the respective support frame 2, the various machines 1 can be permanently installed along a decoration line and do not have to be entirely moved—given that it is sufficient to move/exchange the decoration elements 7.

It is specified that the movement means 18 can also be of another type, with respect to that described above.

For example, they can comprise a single electric motor in place of two, or they can comprise actuator means 19,20 of another type, e.g. pneumatic actuator means.

The specific type of the movement means 18, as well as their particular shape/arrangement, hence do not constitute a limitation of the protective scope of the present invention.

Figure 9:
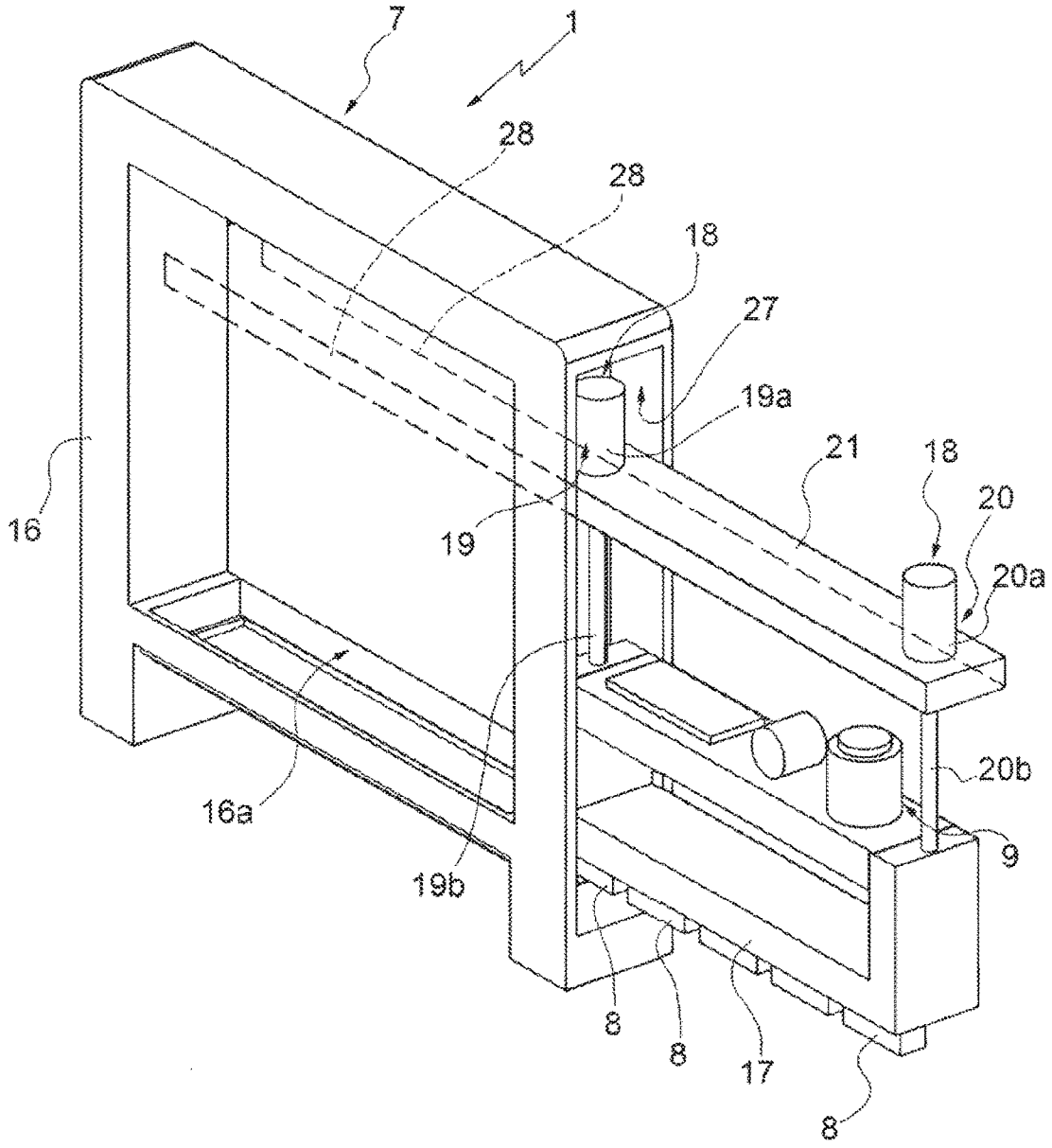
FIG. 9 is a perspective view of a print element of the decorator machine according to another embodiment of the invention.

Another embodiment of the present invention is illustrated in FIG. 9.

In this embodiment, in at least one of the decoration elements 7, the support portion 21 of the movement members 18, with the support 17 of the print heads 8 associated therewith, is rendered slidable, with respect to the casing 16, according to a horizontal direction.

More in detail, the support portion 21 is slidable, together with the support 17, with respect to the casing 16 according to a horizontal direction orthogonal to the advancement direction 4 of the products to be decorated P.

The members 9 for feeding the decorative fluid can be integral with the support 17 or with the support portion 21.

In detail, a front window 27 is provided in the casing 16, through which the support portion 21 and the support 17 can be completely extracted outside the bulk of the support frame 2.

The front window 27 can be closed by a respective door, not illustrated in the figures.

Guides 28 are provided which allow the sliding of the support portion 21 and/or of the support 17 with respect to the casing 16.

In particular, the support portion 21, together with the movement members 18 and the support 17, are translatable according to a direction orthogonal to the advancement to direction 4 when the support 17 itself is in the respective inactive position.

Possibly, the support 17 can be associated below the protection 22 for preserving the heads 8.

The solution that distinguishes the present embodiment allows rendering the maintenance operations of the decoration element 7 of interest particularly quick and 15 easy.

Indeed, in this manner, the decoration element 7 of interest can be at least partially or completely translated outside the bulk of the conveyor 3.

This can for example allow carrying out maintenance (or cleaning) operations on the heads 8 without dismounting any part of the machine, accessing it from below since 20 there is sufficient space for the operator to work.

The support 17, together with all the components associated therewith, can also be completely removed and taken away from the respective casing 16.

It was thus seen that the invention attains the preset objects.

The present invention was described according to preferred embodiments, but equivalent variants can be conceived without departing from the protective scope offered by the following claims.

The invention claimed is:

1. A digital decorator machine for the decoration of products (P), comprising a support frame, at least one conveyor comprising a conveyor belt, for transporting the products (P) to be decorated along an advancement direction, and a plurality of decoration elements, associated with said support frame by means of connection means of removable type, positioned above said conveyor and arranged side-by-side each other along said advancement direction, each of said decoration elements comprising respective print heads provided with ejector nozzles for a fluid to be dispensed on the surface of the products (P) to be decorated, and a support to which said print heads are associated, each of said decoration elements comprising a respective casing within which said support is housed, said support being movable, with respect to said casing, between an upper inactive position and a lower operating position, in which said heads are correctly spaced with respect to the surface of the products to be decorated (P), wherein said support frame defines two abutment portions parallel to said advancement direction arranged at the sides of said conveyor belt, each of said decoration elements being connectable to said abutment portions in a removable manner.

2. The machine according to claim 1, wherein said connection means are provided between said casing of each of said decoration elements and said abutment portions of said support frame.

3. The machine according to claim 1, wherein said decoration element comprises movement members for moving said support with respect to said casing.

4. The machine according to claim 3, wherein said movement members comprise first actuator means and second actuator means which are associated with said support with vertical or substantially vertical translation axis.

5. The machine according to claim 4, wherein said first actuator means and said second actuator means respectively comprise a first electric motor and a second electric motor, which are respectively associated with a first screw and a second screw, said first screw and second screw being respectively associated with a first nut screw and a second nut screw provided in said support.

6. The machine according to claim 5, wherein said first electric motor and said second electric motor are of stepper type.

7. The machine according to claim 5, wherein at least one between said first electric motor and said second electric motor is associated with a respective position sensor, e.g. a linear encoder, in order to directly verify the actual vertical position of said support with respect to said casing.

8. The machine according to claim 3, wherein said support, together with said movement members, is associated with said casing in a slidable manner in a substantially horizontal direction, such to be partially or completely translated outside said casing through a front window.

9. The machine according to claim 8, wherein said support is partially or completely translatable outside said casing when said support is in the respective inactive position.

10. The machine according to claim 8, wherein said decoration element comprises members for feeding decorative fluid to said heads, and at least one control board for the operation of said heads, said feed members and said control board being integral with said support.

11. The machine according to claim 10, comprising a container 404 containing the decorative fluid, positioned in any one zone of the machine, communicating with said feed members.

12. The machine according to claim 1, wherein said decoration element comprises a protection removably associable with the base of said support in order to protect said print heads.

13. The machine according to claim 12, wherein said protection has tray form, or tub form, with concavity directed upward during use.

14. The machine according to claim 12, wherein said protection is associated with the base of said support when this is in the respective inactive position, and completely covers said heads.

15. The machine according to claim 1, wherein said connection means comprise conical portions associated with the base of said casing, and corresponding conical housings provided in respective upper abutment portions of said support frame.

16. The machine according to claim 15, wherein said abutment portions comprise respective longitudinal members of said support frame, parallel to said advancement direction.

17. The machine according to claim 1, comprising at least one supervision unit which is operatively connected to said decoration element.

* * * * *